US008791424B2

(12) United States Patent
Cloetta

(10) Patent No.: US 8,791,424 B2
(45) Date of Patent: Jul. 29, 2014

(54) CONTROL GRID DESIGN FOR AN ELECTRON BEAM GENERATING DEVICE

(75) Inventor: Dominique Cloetta, Villars-sur-Glâne (CH)

(73) Assignee: Tetra Laval Holdings & Finance S.A., Pully (CH)

( * ) Notice: Subject to any disclaimer, the term of this patent is extended or adjusted under 35 U.S.C. 154(b) by 12 days.

(21) Appl. No.: 13/814,612

(22) PCT Filed: Aug. 24, 2011

(86) PCT No.: PCT/EP2011/064499

§ 371 (c)(1),
(2), (4) Date: Feb. 6, 2013

(87) PCT Pub. No.: WO2012/025546

PCT Pub. Date: Mar. 1, 2012

(65) Prior Publication Data

US 2013/0140474 A1 Jun. 6, 2013

(30) Foreign Application Priority Data

Aug. 26, 2010 (SE) ..... 1000866

(51) Int. Cl.

| | |
|---|---|
| ***G21K 1/08*** | (2006.01) |
| ***H01J 3/14*** | (2006.01) |
| ***H01J 3/26*** | (2006.01) |
| ***H01J 49/42*** | (2006.01) |

(52) U.S. Cl.
USPC ..... 250/396 R; 250/398

(58) Field of Classification Search
USPC ..... 250/396 R
See application file for complete search history.

(56) References Cited

U.S. PATENT DOCUMENTS

| | | | | | |
|---|---|---|---|---|---|
| 5,373,137 | A | * | 12/1994 | McLaughlin | 219/121.68 |
| 5,463,200 | A | * | 10/1995 | James et al. | 219/121.68 |
| 5,924,277 | A | * | 7/1999 | Beattie et al. | 60/202 |
| 5,962,995 | A | | 10/1999 | Avnery | |
| 6,157,039 | A | * | 12/2000 | Mankos | 250/492.2 |
| 6,538,256 | B1 | * | 3/2003 | Mankos et al. | 250/492.24 |
| 6,864,485 | B2 | * | 3/2005 | Kahn et al. | 250/396 R |
| 7,244,949 | B2 | * | 7/2007 | Knippelmeyer et al. | 250/396 ML |
| 7,345,290 | B2 | * | 3/2008 | Katsap et al. | 250/492.2 |
| 2002/0130606 | A1 | * | 9/2002 | Suzuki et al. | 313/407 |
| 2004/0232349 | A1 | * | 11/2004 | Kruit | 250/396 R |
| 2006/0253510 | A1 | | 11/2006 | Kameyama et al. | |

FOREIGN PATENT DOCUMENTS

| | | | | | |
|---|---|---|---|---|---|
| JP | 3-002600 | A | | 1/1991 | |
| JP | 9-166700 | A | | 6/1997 | |
| JP | 10-010300 | A | | 1/1998 | |
| JP | 10010300 | A | * | 1/1998 | G21K 5/04 |

OTHER PUBLICATIONS

International Search Report (PCT/ISA/210) issued on Nov. 23, 2011, by the European Patent Office as the International Searching Authority for International Application No. PCT/EP2011/064499.

* cited by examiner

*Primary Examiner* — Jack Berman
*Assistant Examiner* — Sean Luck
(74) *Attorney, Agent, or Firm* — Buchanan Ingersoll & Rooney PC

(57) ABSTRACT

The invention relates to a control grid for an electron beam generating device, wherein the control grid comprises apertures arranged in rows in a width direction and columns in a height direction, wherein a majority of the apertures in a row have the same size, and wherein the size of the apertures of at least one row differs from the size of the apertures of another row.

4 Claims, 5 Drawing Sheets

CONTROL GRID DESIGN FOR AN ELECTRON BEAM GENERATING DEVICE

FIELD OF THE INVENTION

The present invention generally refers to the field of electron beam generating devices, and particularly to a control grid of such a device.

TECHNICAL BACKGROUND

Electron beam generating devices may be used in sterilization of items, such as for example in sterilization of food packages or medical equipment, or they may be used in curing of e.g. ink.

An electron beam generating device according to prior art is partly disclosed in FIGS. 1 and 2. The electron beam device 100 comprises two parts; a tube body 102 housing and protecting the assembly 103 generating and shaping the electron beam, and a flange 104 carrying components relating to the output of the electron beam, such as a window foil 106 and a support plate 108 preventing the window foil 106 from collapsing as vacuum is established inside the device 100. The support plate 108 should prevent the window foil 106 from collapsing while being transparent enough not to interfere with passing electrons. The copper support plate 108 further has an important purpose in conducting heat away from the foil, which otherwise would experience a shortened usable lifetime. The support plate 108 is attached to the flange 104, and the window foil 106 is welded onto the support plate 108 along a line (not shown) extending along the perimeter of the copper support 108.

Electrons are generated by the filament 110 and accelerated towards the window foil 106 by means of an applied voltage. On their way they pass a control grid 112 which may be given an electrical potential in order to control the electron beam.

As such, the maximum power output from the electron beam device is generally limited by the foil, since excessive powers will generally be limited by the durability of the foil. In a practical case the output current density will be distributed over the foil surface in what is referred to as the beam profile. The optimal beam would have a profile along an X-direction (shorter dimension of the window) as shown in FIG. 6 (dotted line) leading to a temperature distribution (dashed line) with a constant plateau region over the entire foil surface, in which case the level of the plateau region could reside on a level slightly above the level needed for sterilization. This is however rarely the case, and instead the beam profile follows a bimodal distribution (in the X-direction).

SUMMARY OF THE INVENTION

The present invention provides a solution to the above problem by the provision of a control grid for an electron beam generating device, said control grid comprising apertures arranged in rows in a width direction and columns in a height direction, wherein a majority of the apertures in a row have the same size, and wherein the size of the apertures of at least one row differs from the size of the apertures of another row. The approach to alter the size of the apertures has proven to be an expedient manner to adjust the output beam profile from the electron beam generating device. The word "majority" designates "more than half" in the usual sense. In a practical case, the only apertures not following the criterion of having the same size are apertures along the circumference of the control grid, where special measures may have to be taken in order to control the beam profile.

In one or more embodiments a row closer to a centerline of the control grid, said centerline being parallel to the width direction, has apertures with a smaller size than a row farther away from the centerline.

In one or more embodiments a majority of the apertures in a row have a uniform height and width, a majority of the apertures of the control grid have the same width, and wherein the height of the apertures of at least one row differs from the height of the apertures of another row. The approach to maintain the width of the apertures while altering their height has proven to be an expedient manner to adjust the output beam profile from the electron beam generating device. As above, the word "majority" designates "more than half". The only apertures not following the criterion of having the same width are apertures along the circumference of the control grid, where special measures may have to be taken in order to control the beam profile.

In one or more embodiments a row closer to a centerline of the control grid, said centerline being parallel to the width direction, has apertures with a smaller height than a row farther away from the centerline.

In one or more embodiments a row aligned with said centerline of the control grid has apertures with a smaller height than a row farther away from the centerline.

In one or more embodiments adjacent rows are shifted, in the width direction, half a center-to-center distance between adjacent apertures of a row, such that an aperture in one row is arranged at equal distances from the two neighboring apertures of an adjacent row.

In one or more embodiments the apertures have hexagonal shape.

In one or more embodiments the apertures of the rows form a honeycomb-shaped structure. It has been found that a honeycomb structure is highly suitable for a control grid since it gives a high electron transparency. This is due to the fact that the structure has a high mechanical strength even when if material thicknesses are small.

In one or more embodiments the material thickness between the apertures in the honeycomb-shaped structure is in the range of 0.4-1.2 mm.

In one or more embodiments the control grid is made of a sheet material plate having a material thickness in the range of 0.4-1.2 mm.

BRIEF DESCRIPTION OF THE DRAWINGS

In the following, a presently preferred embodiment of the invention will be described in greater detail, with reference to the enclosed drawings, in which.

DESCRIPTION OF EMBODIMENTS

Figure 1:
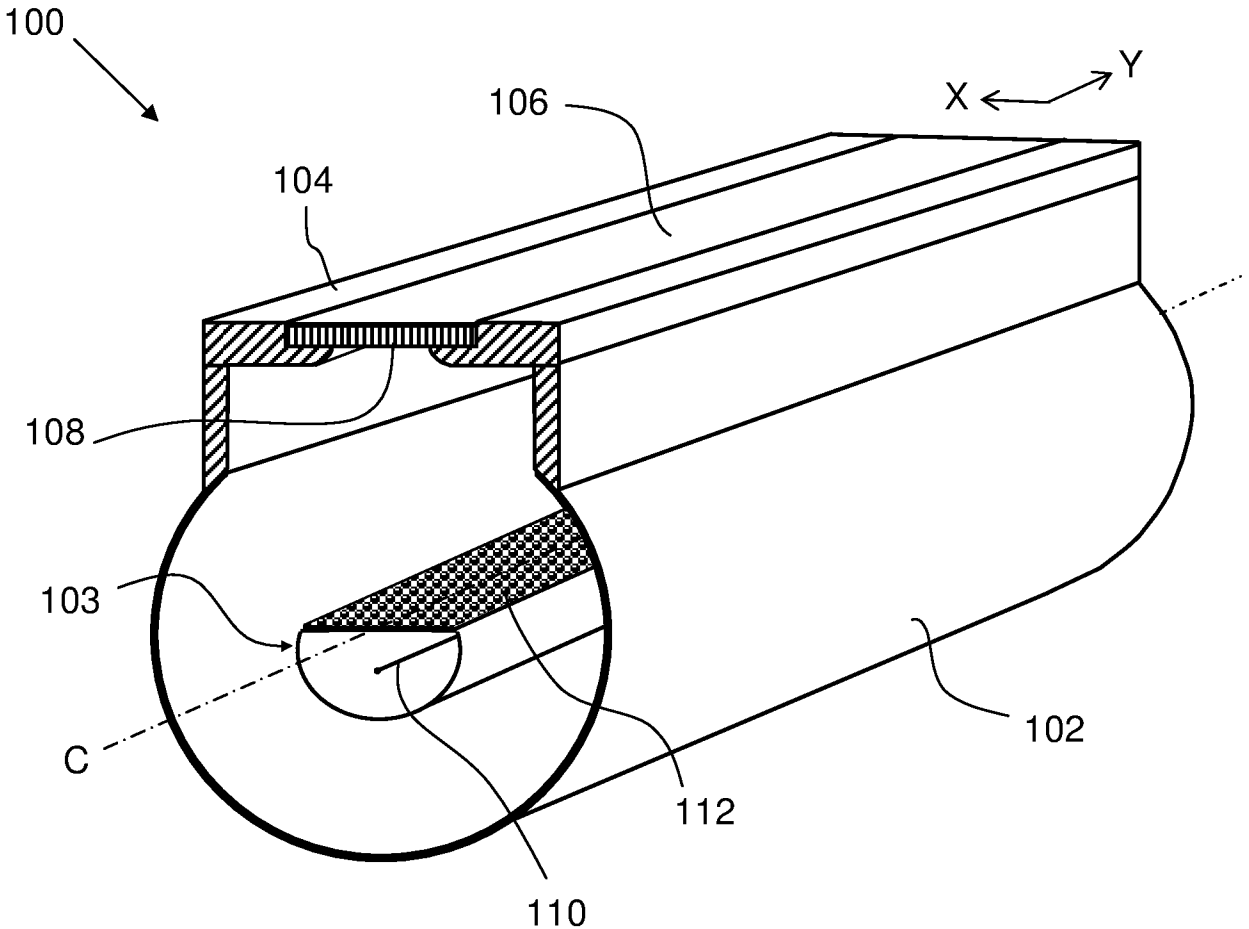
FIG. 1 shows a schematic cross sectional isometric view of a part of an electron beam device according to prior art.
Figure 2:
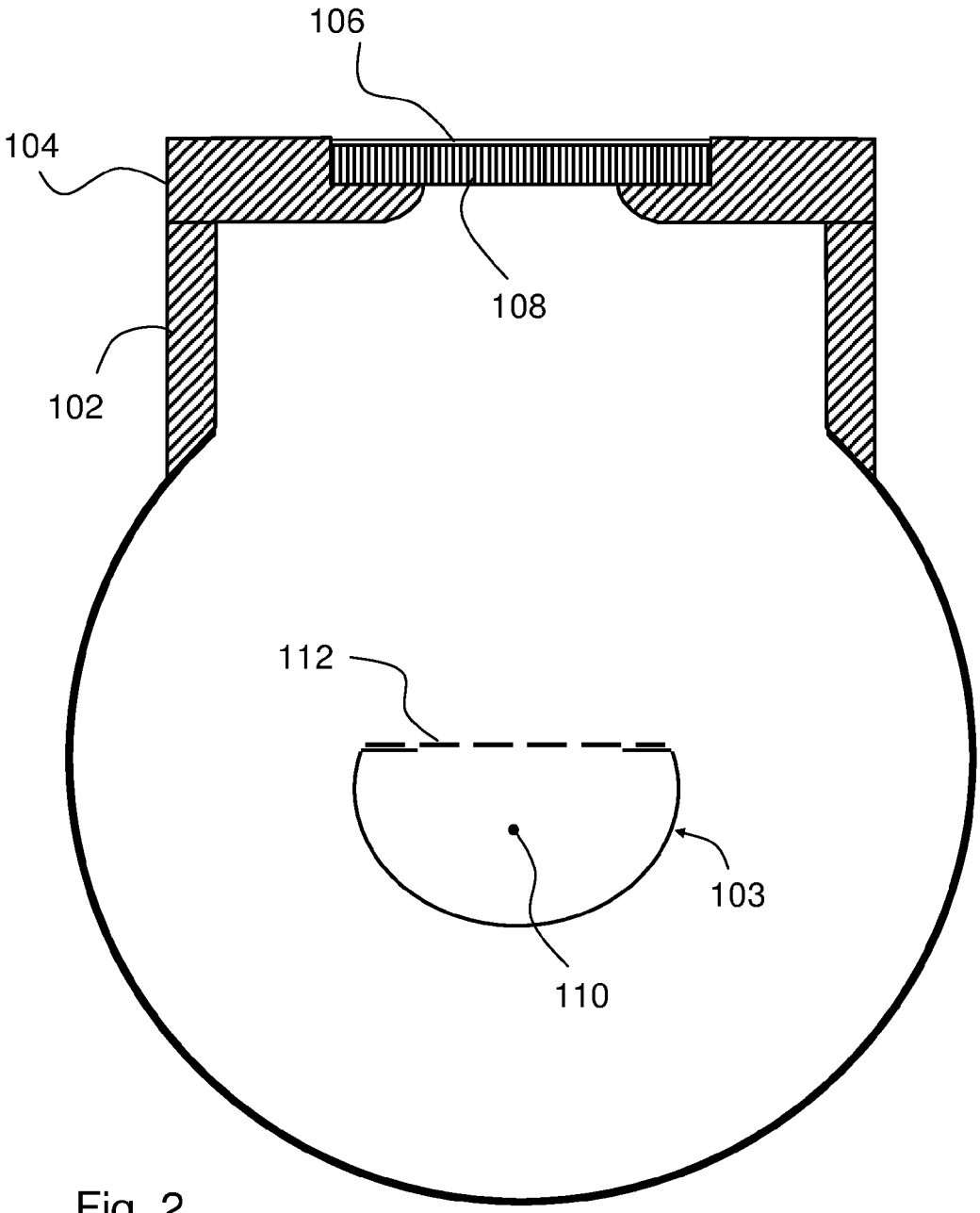
FIG. 2 shows a schematic cross sectional view of the device of FIG. 1.
Figure 3A:
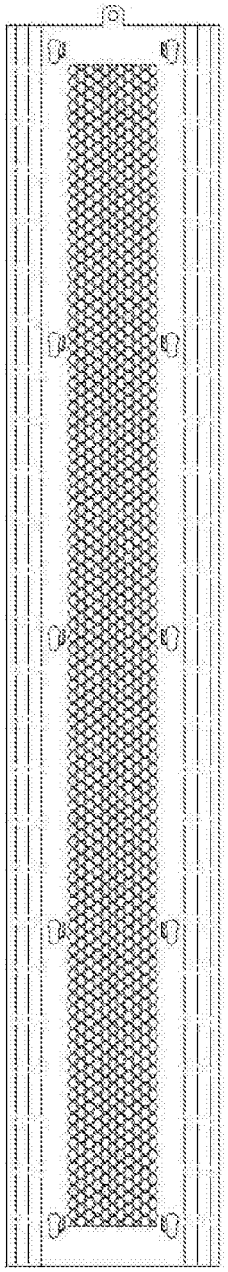
FIG. 3*a* shows a schematic plan view of a control grid according to a first embodiment of the invention.
Figure 3B:
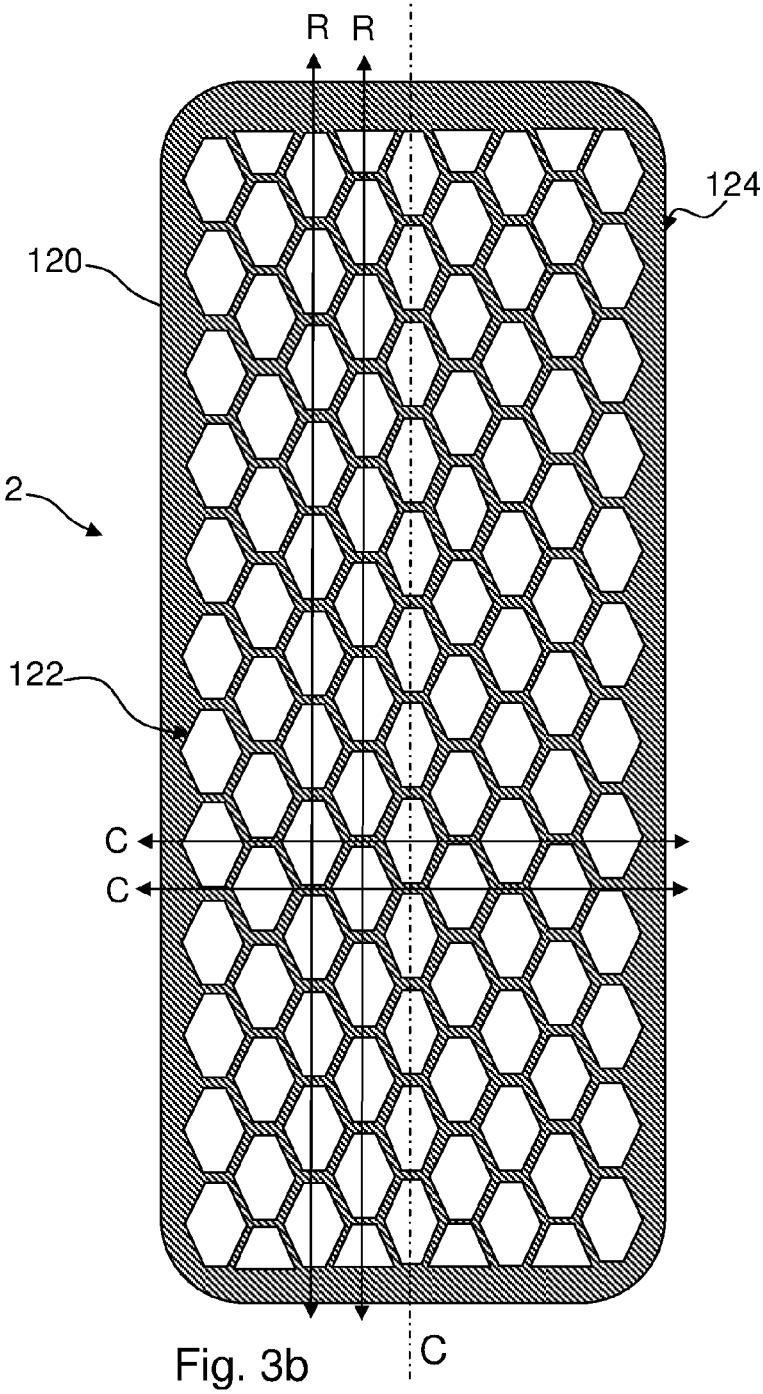
FIG. 3*b* shows a simplified plan view of a control grid according to the first embodiment.

FIGS. 1 and 2 have already been described in the background section, and will not be described in any further detail here. Instead FIG. 3*a* shows a plan view of a control grid 112 in accordance with a first embodiment of the present invention. A simplified view is shown in FIG. 3*b*. The control grid 112 is an essentially rectangular shaped plate 120 with apertures 122. The plate is preferably made of sheet having a material thickness preferably in the range of 0.4-1.2 mm. The control grid in FIG. 3*n* is just a simplified exemplary control grid, and the skilled person realizes that the proportions and sizes shown may be altered as needed to fit the electron beam generating device. For example the control grid may look like in FIG. 3*a*.

In FIG. 3*b* it is shown a centerline C extending in the length direction of the control grid 112. The apertures 122 are substantially evenly distributed over a center area of the control grid leaving a frame 124 without apertures at the circumference of the control grid 112. From FIGS. 1 and 2 the filament of the electron beam generating device extends in a direction which is aligned and in parallel with the centerline C of the control grid 112. Hence the intensity of the electron beam will be the highest at the center of the control grid 112.

Figure 4:
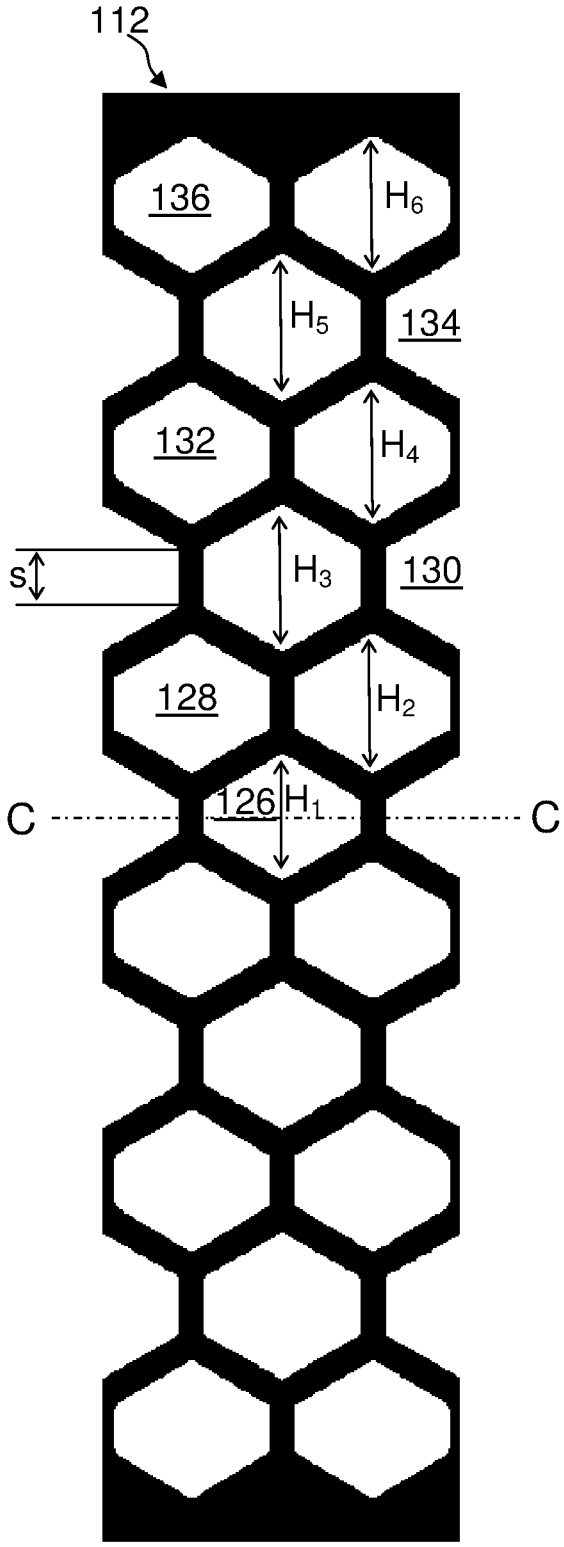
FIG. 4 is a schematic plan view of a segment of a control grid according to the embodiment of FIG. 3.

In the schematic plan view of FIG. 4 only a segment of a control grid 112 is shown, yet the skilled person realizes that by arranging such segments side by side, a complete control grid like the one in FIG. 3*a* may be accomplished. The apertures 122 have hexagonal shape, and together the apertures 122 form a honeycomb-shaped structure.

The apertures 122 are arranged in rows R in a width direction, indicated by W, and in columns C in a height direction, indicated by H, in FIG. 3. As can be seen the width direction W is aligned with the direction of the centerline C. A first row 126 is arranged aligned with the centerline C, see FIG. 4. Further rows 128-136 are arranged one after the other and more distant from the centerline C. Due to the honeycomb-shaped structure adjacent rows are shifted, in the width direction W, half a center-to-center distance between adjacent apertures of a row, such that an aperture in one row is arranged at equal distances from the two neighboring apertures of an adjacent row.

Preferably, a majority of the apertures in a row have the same size. The size of the apertures of at least one row differs from the size of the apertures of another row. In the first embodiment a majority of the apertures in a row have a uniform height and width. The height in the hexagonal shape is here defined as the largest distance between two directly opposed corners dividing the hexagonal shape into two isosceles trapezoids. Hence the width of the hexagonal shape is measured between two parallel sides thereof. The heights of the apertures in the different rows 126-136 are shown by arrows denoted $H_1$-$H_6$. In this first embodiment the hexagonal shapes are oriented so that the height direction H is perpendicular to the centerline C of the control grid 112. A majority of all the apertures 122 of the control grid 112 has the same width W. However, the height of the apertures of at least one row differs from the height of the apertures of another row. In this first embodiment a row closer to the centerline C of the control grid 112 has apertures with a smaller size than a row farther away from the centerline C. This implies that there is relatively more control grid material and less aperture area in that row than in neighboring rows. This affects among other things the electron transparency which will be less with more control grid material present.

As can be seen in FIGS. 3*b* and 4 the apertures in the row 126 being aligned with the centerline C has a hexagonal shape with a smaller height $H_1$ than a row farther away from the centerline C, for example row 128. At the centerline C the beam intensity is very high, and thus it is considered to be favourable to have less transparency in that area for the purpose of creating a suitable current density profile.

The height of the hexagonal shapes of the apertures is preferably altered by reducing the length of the parallel sides of the hexagon being parallel with the height direction. One such parallel side is denoted s in FIG. 4. In this way one row may have another height than the others, still keeping a substantially uniform honeycomb-shaped structure.

Figure 5:
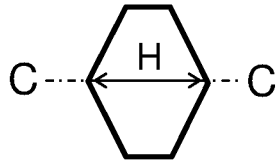
FIG. 5 is a view of an aperture of a second embodiment.

The hexagonal shapes may in a second embodiment, part of which is shown in FIG. 5, be oriented with the height instead directed in parallel with the centerline C. In this case the height and width directions of the control grid do not correspond to the height and width directions of the apertures/hexagonal shapes. Still, the size of the hexagonal shapes is preferably adjusted along the height H of the hexagonal shape, to keep the honeycomb-shaped structure.

The material thickness between the apertures 122 in the embodiment shown in FIG. 4, i.e. the framework forming the edges of the hexagonal-shaped apertures and the honeycomb-shaped structure, is in the range of 0.4-1.2 mm. This gives a high mechanical strength at the same time as the material thickness is kept small. Further, the heights $H_1$-$H_6$ are in the range of 3-4 mm. The difference in height between a row and a neighboring row may be as little as 0.1 mm. The width W of the apertures is in the range of 3.5-4.5 mm.

Figure 6:
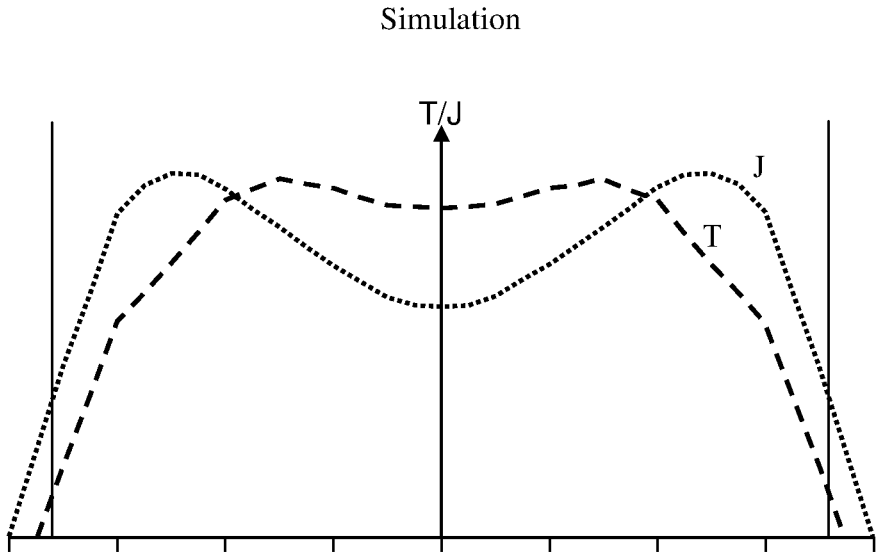
FIG. 6 is a graph illustrating an ideal current density profile (dotted line) and the corresponding foil temperature (dashed line) as a function of spatial position.

FIG. 6 shows the result of simulations showing a current density profile (dotted line) and the resulting foil temperature (dashed line) as a function of spatial position, for an ideal control grid. It can be seen that the temperature has an even profile, which has been proven important for increasing the life time of the foil.

The reason for the lack of correlation between the current density and the temperature is that the rate of heat transportation is much higher near the border of the support plate. This implies that having a homogenouos current density would not result in the desired temperature profile.

Figure 7:
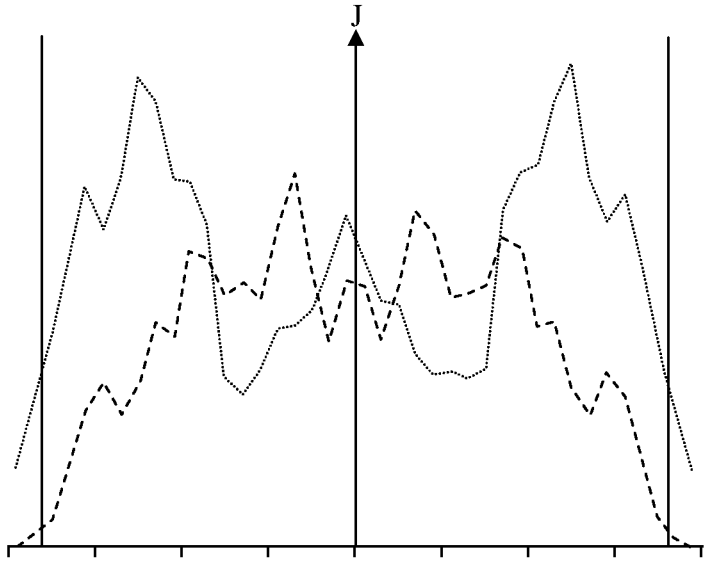
FIG. 7 is a graph illustrating current density as a function of spatial position for two different control grid designs, based on simulations.

FIG. 7 is a graph illustrating current density profiles as a function of spatial position for two different control grid designs, based on simulations. The dotted line represents a control grid in accordance with the first embodiment of the present invention, and the dashed line represents a control grid in accordance with prior art. The latter control grid comprising regularly arranged circular openings. It is evident that a control grid in accordance with the first embodiment of the invention results in a current density profile close to the ideal, whereas the prior art profile would result in a beam profile with large internal fluctuations, particularly considering that the sloping effect at the edges will be enhanced by the increased cooling rate near the borders.

The invention claimed is:

1. A control grid for an electron beam generating device comprising:

a plurality of hexagonal-shaped apertures arranged in rows and columns, each row extending parallel to a longitudinal axis of the control grid, each column extending orthogonal to the longitudinal axis of the control grid, each of the hexagonal-shaped apertures possessing a width extending parallel to the longitudinal axis of the control grid and a height extending orthogonal to the longitudinal axis of the control grid; and a majority of the hexagonal-shaped apertures in each individual row possess the same height and the same width, the height of at least some of the hexagonal-shaped apertures in a first one of the rows differs from the height of at least some of the hexagonal-shaped apertures in a second one of the rows, and the width of at least some of the hexagonal-shaped apertures in the first one of the rows is the same as the width of at least some of the hexagonal-shaped apertures in the second one of the rows.

2. The control grid of claim 1, wherein the first one of the rows overlaps a centerline of the control grid, and the height of at least some of the hexagonal-shaped apertures in the first one of the rows is less than the height of at least some of the hexagonal-shaped apertures in the second one of the rows.

3. The control grid of claim 1, every other row of hexagonal-shaped apertures is shifted in a direction parallel to the longitudinal axis relative to the other rows of hexagonal-shaped apertures so that the rows of hexagonal-shaped apertures form a honeycomb shape.

4. The control grid of claim 1, wherein the first one of the rows is closer to a centerline of the control grid than the second one of the rows, and the height of at least some of the hexagonal-shaped apertures in the first one of the rows is less than the height of at least some of the hexagonal-shaped apertures in the second one of the rows.

* * * * *